United States Patent [19]

Ogura et al.

[11] Patent Number: 4,803,512

[45] Date of Patent: Feb. 7, 1989

[54] IMAGE FORMING CARTRIDGE FOR PROVIDING UNIFORM CORONA CHARGING

[75] Inventors: Mitsuru Ogura, Nara; Takeshi Yoshida; Shoichiro Yoshiura, both of Yamatokoriyama, all of Japan

[73] Assignee: Sharp Kabushiki Kaisha, Osaka, Japan

[21] Appl. No.: 49,512

[22] Filed: May 14, 1987

[30] Foreign Application Priority Data

May 16, 1986 [JP] Japan ..... 61-74214[U]

[51] Int. Cl.[4] ..... G03G 15/00; G03G 15/02; H01T 19/00

[52] U.S. Cl. ..... 355/3 CH; 355/14 CH; 250/324; 250/325

[58] Field of Search ..... 355/3 CH, 14 CH; 250/324–326

[56] References Cited

U.S. PATENT DOCUMENTS 4,627,701 12/1986 Onoda et al. ..... 355/3 CH

*Primary Examiner*—A. C. Prescott
*Assistant Examiner*—Jane Lau
*Attorney, Agent, or Firm*—Birch, Stewart, Kolasch & Birch

[57] ABSTRACT

An image forming cartridge houses a charger unit integrally with respect to a photoreceptor.

Charge wire positioning members are provided on the image forming cartridge body at positions corresponding to holes provided in the charger unit aligned with the charge wire in the charger unit. The charge wire positioning members are spaced at a specified distance from the photoreceptor to ensure uniform charging of the photoreceptor by the charge wire.

3 Claims, 2 Drawing Sheets

IMAGE FORMING CARTRIDGE FOR PROVIDING UNIFORM CORONA CHARGING

BACKGROUND OF THE INVENTION

The present invention relates to an image forming cartridge which houses and supports a charger unit integrally with respect to a photoreceptor in such a manner that a charge wire for charging the photoreceptor surface is provided at an appropriate fixed position with respect to the photoreceptor.

An electrophotographic copying machine uses a photoreceptor to copy an image. After electrically charged, the photoreceptor is exposed to light reflected from a manuscript to form a latent image on the photoreceptor surface. The latent image made visible with developer toner is transferred onto a copy paper. Irregular charging of the photoreceptor results in an image of irregular density which lead to deterioration in the developed image quality. In order to prevent such irregular charging provided in the charger unit aligned with the charge and to ensure uniform charging of the photoreceptor, it is necessary to set the charger wire at an appropriate distance from the photoreceptor.

SUMMARY OF THE INVENTION

The object of the present invention is to provide an image forming cartridge of low cost which is capable of maintaining an appropriate distance between a charger wire and a photoreceptor by using a minimum number of parts, wherein assembly and adjustment are made easy.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above object, according to one embodiment of the present invention, an image forming cartridge is provided, which houses and supports at least a charger unit integrally with respect to a photoreceptor. The cartridge comprises charge wire positioning members at positions corresponding to the charger wire of the charger unit and holes formed in the charger unit main body corresponding to the charger wire positioning members, the charge wire positioning members being spaced a specified distance from the photoreceptor to permit uniform charging of the photoreceptor by the charge wire.

According to the above embodiment of the invention, when the charger unit is loaded in the image forming cartridge body, the charge wire is positioned properly by the charge wire positioning members projecting through the holes provided in the charge unit. The charger wire is positioned appropriately because of the fixed, specified distance between the charge wire positioning members and the photoreceptor. The charge wire positioning members are fixed to the image forming cartridge and will not move, thus the charge wire too is positioned at a fixed place. Since all that must be done is to align the charge wire positioning members with the holes of the charger unit, assembly and adjustment are very easy. Moreover, since the only features necessary for proper charging of the photoreceptor are the charge wire positioning members provided in the image forming cartridge body and the holes formed in the charger unit, the copying machine requires a reduced number of necessary parts and therefore incurs a lower cost.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE INVENTION

Figure 3:
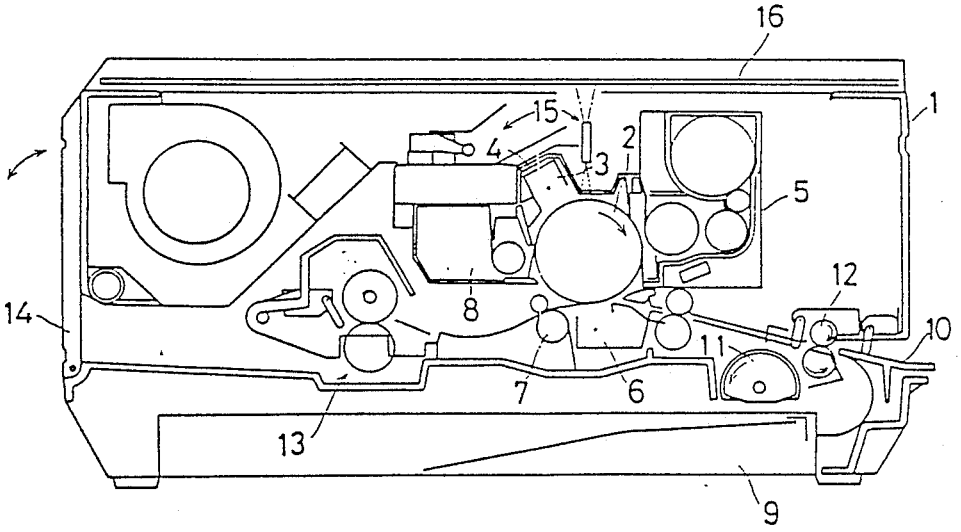
FIG. 3 is a schematic sectional view of the construction of a copying machine using the image forming cartridge of the present invention.

Referring to FIG. 3, a photoreceptor 2 is arranged at the approximate center of a copying machine 1. Around the photoreceptor 2 are arranged a charger unit 3 for charging the photoreceptor 2, a developing unit 5 for applying developer toner to the surface of the photoreceptor 2, a transfer unit 6 for transferring the developer toner from the photoreceptor 2 to a copy paper, a separator unit 7 for separating the copy paper from the photoreceptor 2 and a cleaner unit 8 for removing residual developer toner from the photoreceptor 2, in this order. The photoreceptor 2 is charged by the charger unit 3 as it is rotated in the direction indicated by the arrow in FIG. 3. Light reflected from a manuscript placed on a manuscript rest 16 is irradiated by an optical system 15 onto the charged surface of the photoreceptor 2, forming a latent image on the photoreceptor 2. The developer unit 5 applies developer toner to the latent image. Meanwhile, a paper supplied from a paper feeder cassette 9 or a manual paper feed tray 10 is transmitted by means of paper feed rollers 11 and 12 to the photoreceptor 2. The developer toner on the surface of the photoreceptor 2 is selectively transferred to the paper by the transfer unit 6. Then the paper is separated from the photoreceptor 2 by the separator unit 7 and transmitted to a fixing device 13 where the developer toner is fixed on the paper. Finally, the paper is discharged to a tray 14 which is pivotally foldable to the copying machine body.

The photoreceptor 2 and the charger unit 3 are housed and fixed as one within an image forming cartridge body 4.

Figure 1:
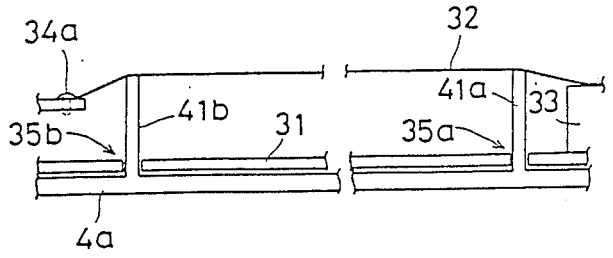
FIG. 1 is a partial, sectional view of the image forming cartridge of the present invention.
Figure 2:
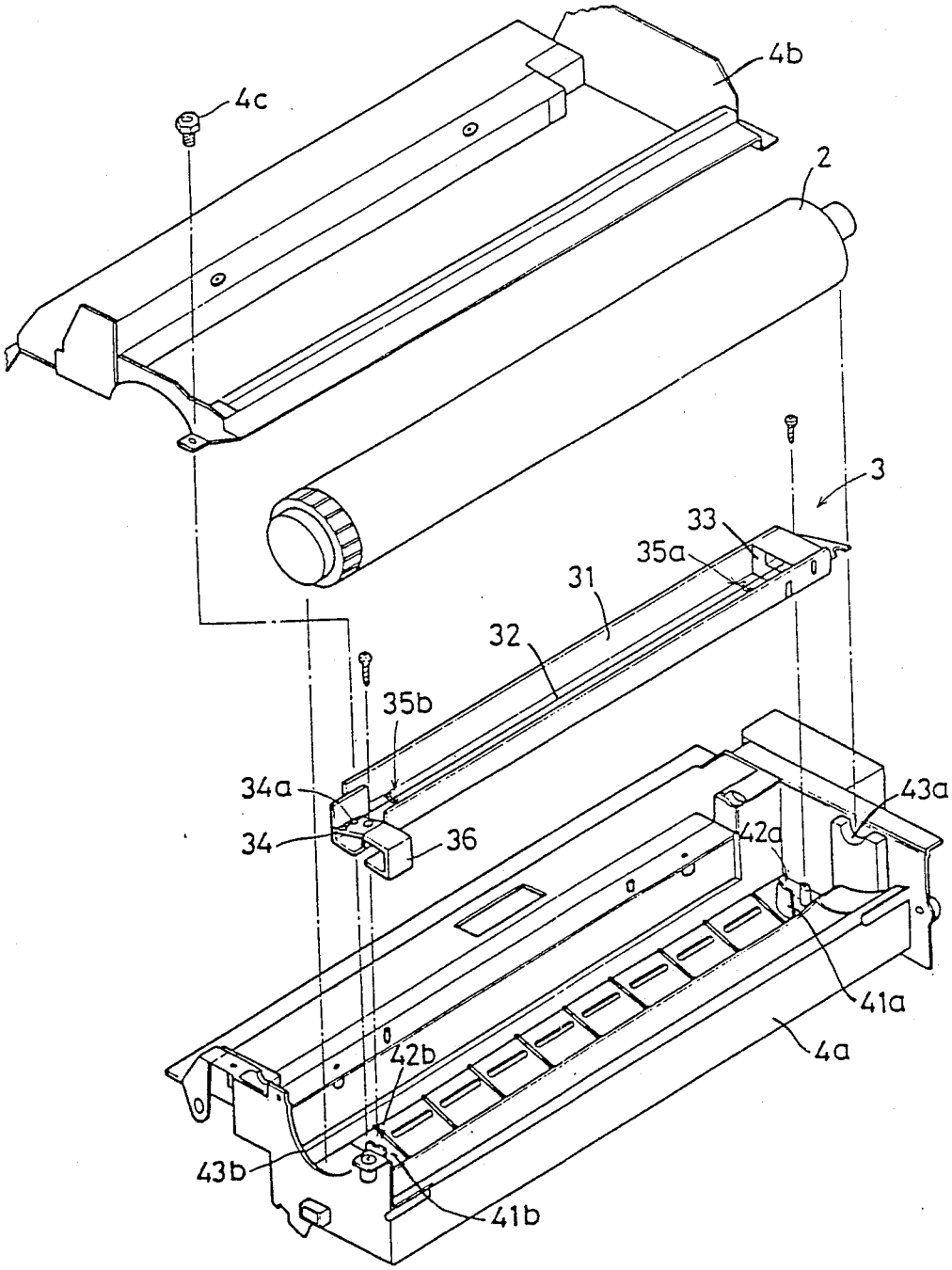
FIG. 2 is an exploded view of the image forming cartridge of the present invention.

FIG. 2 is an exploded, perspective view of the image forming cartridge assembly housing the photoreceptor 2 and the charger unit 3. FIG. 1 shows a part of the assembly in section. The lower side of FIG. 2 corresponds to the upper side of FIG. 3.

The image forming cartridge body 4 comprises an upper frame **4*a* and a lower frame 4*b* which are connected with each other by a screw 4*c*. The charger unit 3 is mounted on the upper frame 4*a*. The charger unit 3 comprises a charger wire 32 extending longitudinally in a unit box 31 of a U-shaped section. The charge wire 32 is fixed at one end to a retainer 33 in the front end of the unit box 31 and fixed at the other end by a retainer pin 34*a* in a retaining hole 34 in the rear end so that the charge wire 32 has a specified tension. Holes 35***a* and 35*b* are formed in the front and rear portions of the bottom of the unit box 31. Positioning members 41*a* and 41*b* projecting from the front and rear parts of the inner wall of the upper frame 4*a* pass through the holes 35*a* and 35*b* of the unit box 31. Recesses 42*a* and 42*b* are formed in the tops of the positioning members 41*a* and 42*b*, respectively, at positions corresponding to the charge wire 32. The charge wire 32 which extends between the retainer 33 and the retaining hole 34 passes through the recesses 42*a* and 42*b* and resulting image deterioration to provide a specified tension. The height or depth of the recesses 42*a* and 42*b* in the positioning members 41*a* and 41*b*, respectively, is such that it permits the charge wire 32 to charge the photoreceptor 2 uniformly. The front and rear parts of the charger unit 3 are screwed to the upper frame 4*a*. A grip 36 is provided in the rear end of the charger unit 3. The charger unit 3 can be easily mounted on the upper frame 4*a* when held by the grip 36.

Photoreceptor supports 43*a* and 43*b* are provided in the front and rear end portions of the upper frame 4*a* for insertion of the photoreceptor 2. After the photoreceptor 2 is inserted in the supports 43*a* and 43*b*, the lower frame 4*b* is set on the upper frame 4*a* and fixed by the screw 4*c*.

Thus, since the charge wire 32 is positioned properly due to the positioning members 42*a* and 42*b*, it maintains its appropriate position with respect to the photoreceptor 2 even after the charger unit 3 is fixed by the screw to the upper frame 4*a*.

The front panel (not shown) of the copying machine 1 is opened to set the image forming cartridge in the machine.

In a copying machine having the image forming cartridge of the present invention, the charge wire 32 will maintain its required position in relation to the photoreceptor 2, permitting uniform charging of the photoreceptor 2. The features necessary for guaranteeing uniform charging are only the holes 35*a* and 35*b* in the bottom of the charger unit 3 and the positioning members 41*a* and 41*b* provided on the image forming cartridge 4 at the positions corresponding to the holes 35*a* and 35*b*. Accordingly, the cartridge involves a small number of parts, and is manufactured at a low cost and assembled easily.

In the above embodiment of the invention, the charger unit alone is housed integrally with the photoreceptor in the cartridge. However, the developing unit and the cleaner unit may also be housed, in addition to the charger unit, in the cartridge.

While only certain embodiments of the present invention have been described, it will be apparent to those skilled in the art that various changes and modifications may be made therein without departing from the spirit and scope of the present invention as claimed.

What is claimed is:

1. An image forming cartridge for housing and supporting at least a charger unit integrally with a photoreceptor within a copying machine, comprising an image forming cartridge body having an upper frame and lower frame, a photoreceptor mounted on said cartridge body, a charger unit mounted on said upper frame of said cartridge body said charger unit including a charge wire extending longitudinally in said charger unit, said upper frame of said cartridge body having positioning members of a predetermined height projecting therefrom and said charger unit has holes therein corresponding to said positioning members such that said positioning members extend through said corresponding holes so as to engage said charge wire and maintain said charge wire at a specified distance from said photoreceptor to permit uniform charging of said photoreceptor by said charge wire.

2. The image forming cartridge of claim 1, wherein a recess is formed in the top of each respective positioning member corresponding to said charge wire.

3. The image forming cartridge of claim 1, wherein said image forming cartridge is detachably mounted in said copying machine.

* * * * *